US006227638B1

(12) United States Patent
Childers et al.

(10) Patent No.: US 6,227,638 B1
(45) **Date of Patent: *May 8, 2001**

(54) ELECTRICAL REFURBISHMENT FOR INK DELIVERY SYSTEM

(75) Inventors: Winthrop D. Childers; Michael L. Bullock, both of San Diego, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/034,875

(22) Filed: Mar. 4, 1998

Related U.S. Application Data

(63) Continuation-in-part of application No. 08/785,580, filed on Jan. 21, 1997, now Pat. No. 5,812,156.

(51) Int. Cl.[7] ..... B41J 2/195; B41J 29/393

(52) U.S. Cl. ..... 347/7; 347/19

(58) Field of Search ..... 347/7, 19, 23, 347/85–87, 14; 711/103

(56) References Cited

U.S. PATENT DOCUMENTS

| | | | |
|---|---|---|---|
| 4,178,595 | 12/1979 | Jinnai et al. | 347/7 |
| 5,068,806 | 11/1991 | Gattan | 395/113 |
| 5,138,344 | 8/1992 | Ujita | 347/86 |
| 5,414,452 | 5/1995 | Accatino et al. | 347/7 |
| 5,506,611 | 4/1996 | Ujita et al. | 347/86 |
| 5,694,156 | 12/1997 | Hoisington et al. | 347/7 |
| 5,699,091 | 12/1997 | Bullock et al. | 347/19 |
| 5,721,576 | 2/1998 | Barinaga | 347/85 |
| 5,732,751 | 3/1998 | Scmidt et al. | 141/48 |
| 5,835,817 * | 11/1998 | Bullock et al. | 347/7 |

FOREIGN PATENT DOCUMENTS

| | | | |
|---|---|---|---|
| 0658431A2 | 6/1995 | (EP) | B41J/2/175 |
| 0720916 | 7/1996 | (EP) | B41J/2/175 |
| 0780786A2 | 6/1997 | (EP) | G06K/15/00 |
| WO96/05061 | 2/1996 | (WO) | B41J/2/175 |
| WO98/04414 | 2/1998 | (WO) | B41J/2/17 |

* cited by examiner

*Primary Examiner*—John Barlow
*Assistant Examiner*—Juanita Stephens
(74) *Attorney, Agent, or Firm*—Kevin B. Sullivan; Winthrop D. Childers

(57) ABSTRACT

Methods for electrically refurbishing a depleted single-use printer ink container for a printing system allow the ink container to be refilled and re-used. The memory device provides a signal when coupled to the printing system that indicates the volume of ink left in the container. The original memory device is not resettable by the printer. Four ways are described to refurbish the first memory device: (1) erase the memory with an irradiation source and reprogram; (2) remove the memory along with its electrical contacts; (3) leave the memory device and contacts in place and mount a new source of signals and contacts on top of the first set of electrical elements; or (4) sever continuity between the first electrical contacts and the first memory device and connect a second source of signals to the contacts. The new source of signals could be an emulator or a substitute memory device. The emulator or new memory device may be mounted to the ink container, or located remotely.

27 Claims, 6 Drawing Sheets

ELECTRICAL REFURBISHMENT FOR INK DELIVERY SYSTEM

CROSS-REFERENCES TO RELATED APPLICATIONS

This application is a continuation-in-part of U.S. application Ser. No. 08/785,580 filed Jan. 21, 1997 now U.S. Pat. No. 5,812,156. "Apparatus Controlled by Data From Consumable Parts With Incorporated Memory Devices". Also, this application is related to commonly assigned patent application Ser. No. 09/034,874, entitled "Ink Delivery System Adapter" and to patent application Ser. No. 09/034,719, entitled "Ink Container Refurbishment Method". Both applications are filed concurrently with this application and are incorporated herein by reference.

TECHNICAL FIELD

This invention relates in general to refurbishing printer ink containers and in particular to refurbishing the electrical information storage device in printer ink containers.

BACKGROUND OF THE DISCLOSURE

One type of prior art ink-jet printer has a printhead mounted to a carriage that is moved back and forth over print media, such as paper. As the printhead passes over appropriate locations on the printing surface, a control system activates ink-jets on the printhead to eject ink drops onto the print media to form desired images and characters. To work properly, such printers must have a reliable supply of ink for the printhead.

One category of ink-jet printer uses a disposable ink pen that is mounted to and moves with the carriage. In some types of ink-jet printers in this category the ink reservoir portion of the ink pen is replaceable separate from the ink pen. In others, the entire printhead and ink reservoir are replaced as a unit once the ink is depleted.

Another category of printer uses reservoirs that are not located on the carriage. In this category of printer the reservoir intermittently replenishes the printhead with ink. The printhead travels to a stationary reservoir periodically for replenishment. Another type makes use of a replaceable ink reservoir connected to the printhead by a fluid conduit. The printhead is replenished with ink through this fluid conduit.

In the parent application to this application Ser. No. 08/785,580, a replaceable cartridge is described which has a memory device mounted to the housing. When inserted into the printer station, an electrical connection between the printer and the memory device is established. This electrical connection allows for the exchange of information between the printer and the memory. The memory device contains ink container parameters that are utilized by the printer to ensure reliable printer operation and print quality. These parameters are updated automatically when the cartridge is mounted to the printer. The exchange of information assures compatibility of the cartridge with the printer.

Another function for the memory device discussed in Ser. No. 08/785,580 is to prevent the use of the cartridge after the supply of ink is depleted. Operating a printer when the reservoir has been depleted of ink can damage or destroy the printhead portion of the cartridge. The memory devices concerned with this application are associated with the ink container and are updated with information relating to the current amount of ink remaining in the reservoir. When a new ink container is installed, the printer will read information from the memory device, which indicates the amount of ink remaining in the reservoir. During usage, the printer counts the drops of ink being used and updates the memory device associated with the ink container to indicate how much ink is remaining in the ink containers. When the ink is substantially depleted, this type of memory device will provide a signal to the printer which indicates that the reservoir is out of ink or low in ink. When substantially depleted of ink, these ink reservoirs are typically discarded and a new ink reservoir along with a new memory device is installed.

DISCLOSURE OF THE INVENTION

This application describes different methods of refurbishing an ink reservoir that has a memory device that has been altered during usage. For example, after an ink reservoir is used in a printing system and partially depleted of ink the memory device associated with this ink reservoir reflects this partially depleted condition. Refurbishment of this ink reservoir that involves only refilling the ink reservoir is insufficient because the memory device reflects a partially depleted condition. One aspect of the technique of the present invention makes use of a new source of signals that when electrically connected to the printer station terminals, provide a signal indicative of more available ink than the partially depleted condition. The source of signals provides enabling information which allows the reservoir to be refilled and used again. The source of signals may be a second memory device similar to the original. Alternately, this source of signals may be an emulator which is an electronic circuit which functions in a similar manner to the original memory device.

In one refurbishment method, the memory device may be altered by an energy source such as an electric field or exposure to high-energy particles such as x-rays. Once altered the memory is written to again to provide data such as address information and initial volume size. The refilled cartridge having new data stored in the memory is inserted into the printer to exchange information with the memory in a manner similar to a new cartridge.

In one preferred embodiment, the memory device and its associated electrical contacts are formed on a substrate that is bonded to the cartridge housing. A second refurbishment technique of the present invention involves removing the original substrate, including the memory device and the contacts, by prying it from the cartridge housing. A new substrate with new electrical contacts and a new memory device are bonded to the cartridge housing in the same place.

In a third refurbishment technique of the present invention, rather than removing the first substrate, first memory device and first contacts, a new substrate with a new source of signals and new set of electrical contacts are bonded on top of the first substrate. The new substrate covers and insulates the original contacts, blocking them from contacting the mating contacts of the printer.

In a fourth refurbishment method of the present invention, electrical continuity between the memory device and the contacts is severed. The new source of signals is electrically connected to the portion of the original contacts which are electrically isolated from the original memory device. The new source of signals is mounted to the cartridge, or if desired, remotely located from the cartridge.

BEST MODES FOR CARRYING OUT THE INVENTION

Although the present invention comprises methods for electrically refurbishing ink containers for printing systems, the invention may be more clearly understood by first thoroughly discussing one of the printing systems for which this invention may be adapted.

Figure 1:
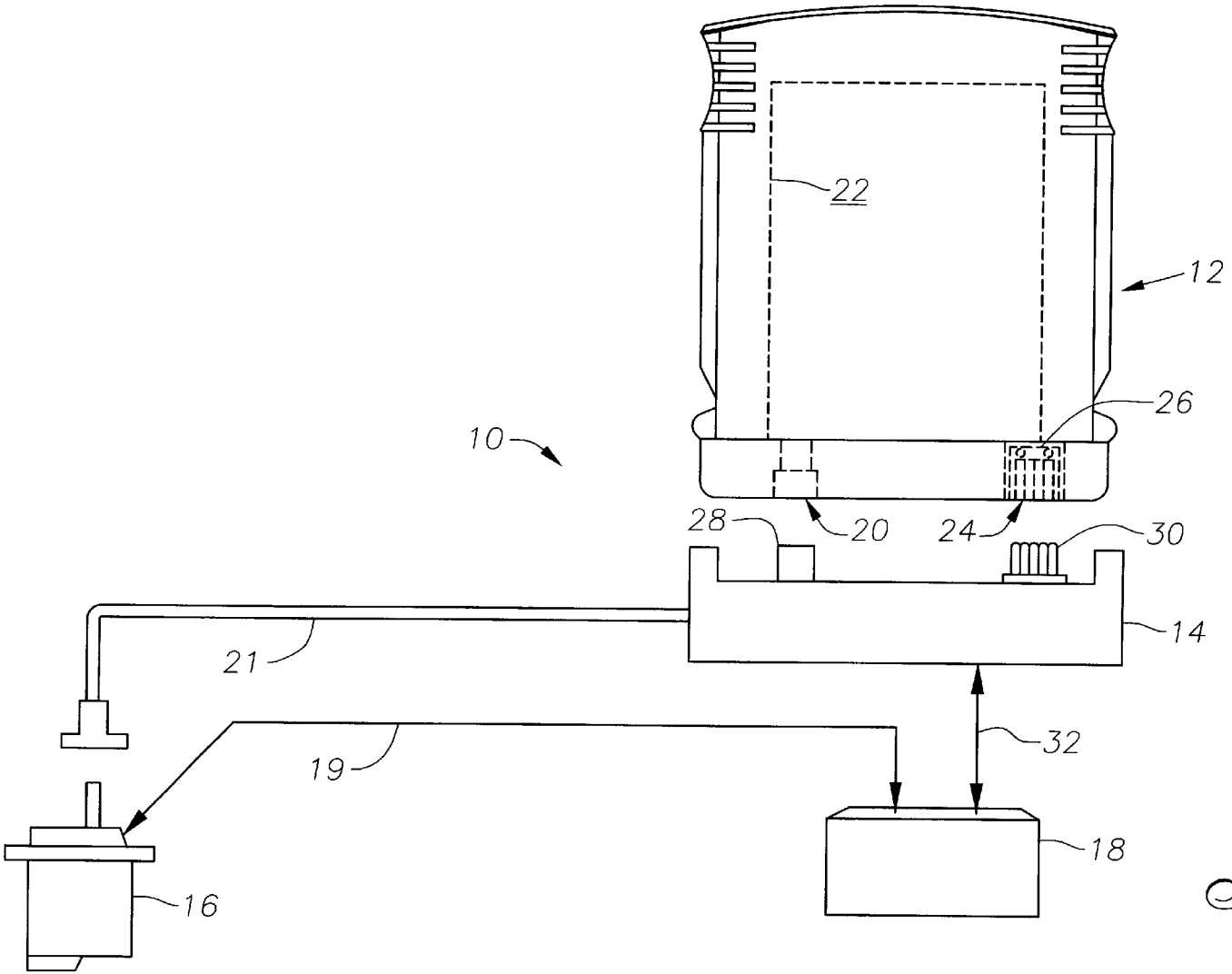
FIG. 1 is a schematic diagram of an ink-jet ink cartridge connected to a printhead, the ink cartridge being of a type for refurbishment in accordance with this invention.

FIG. 1 illustrates a portion of an ink-jet printing system 10 having an original equipment ink cartridge or container 12. The ink-jet printing system 10 includes an ink container receiving station 14, an ink-jet printhead 16, and a print controller 18. Printing is accomplished by the ejection of ink from the printhead 16 under the control of print controller 18. Printhead 16 is connected to the controller 18 by link 19 for controlling ejection of ink. Ink is provided to the printhead 16 by way of a fluid conduit 21, which joins the printhead 16 to the receiving station 14. Ink container 12 includes a fluid outlet 20 which communicates with a fluid reservoir 22. Ink container 12 also includes electrical terminals or contacts 24 which communicate with an information storage device 26 such as a memory device.

Fluid outlet 20 and electrical contacts 24 allow ink container 12 to interconnect with a fluid inlet 28 and electrical contacts 30, respectively, on receiving station 14. Receiving station 14 enables ink to be transferred from fluid reservoir 22 to printhead 16 via fluid conduit 21. In addition, receiving station 14 allows the transfer of information between information storage device 26 and print controller 18 via a link 32.

Figure 2:
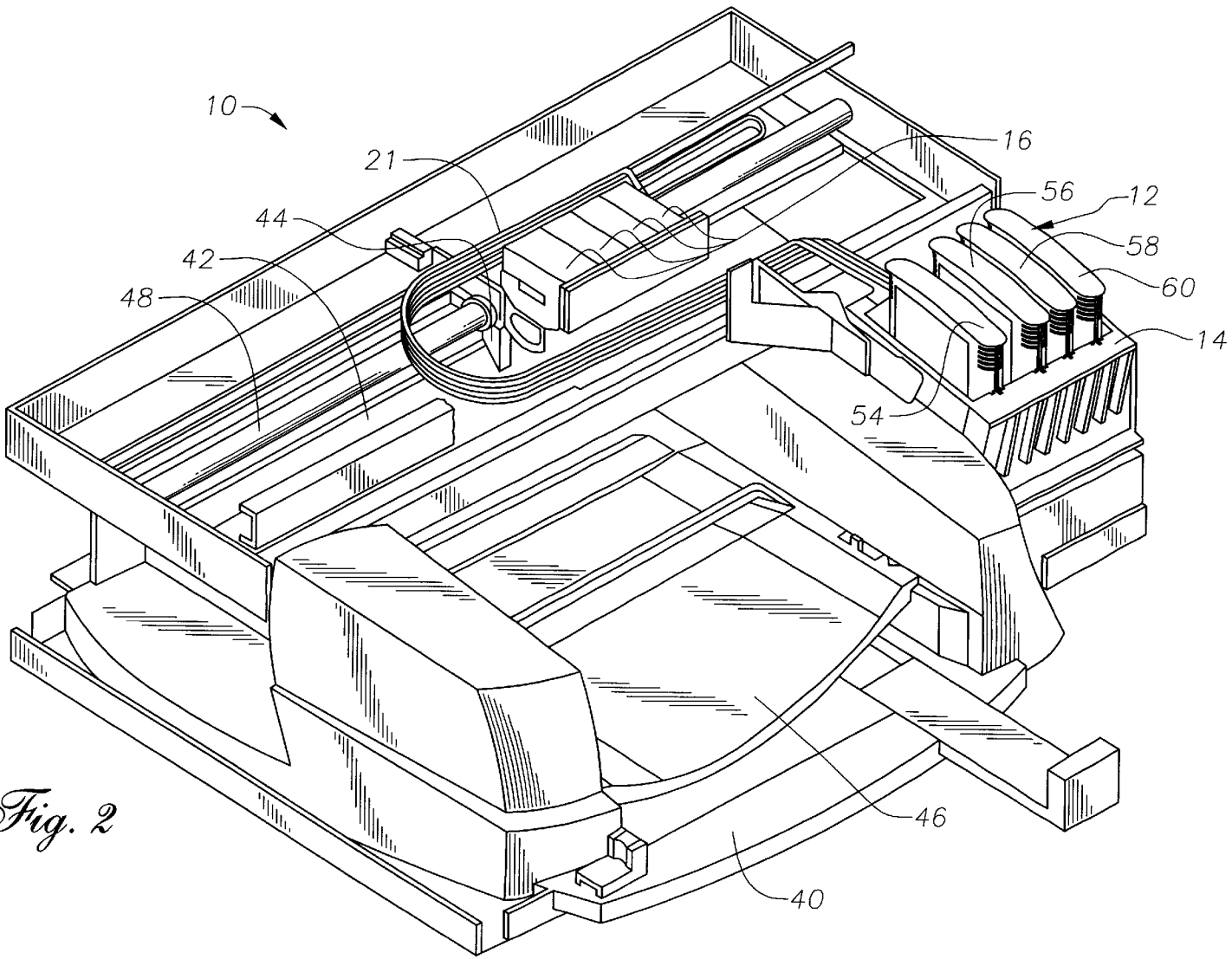
FIG. 2 is an isometric view of an ink-jet printer having several of the ink cartridges of FIG. 1.

Referring now to FIG. 2, printer 10, with its cover removed, is capable of holding four ink containers 12 at the same time. Printer 10 includes a tray 40 for holding a paper supply. When a printing operation is to be initiated, a sheet of paper from tray 40 is fed into printer 10 using a sheet feeder (not shown).

During printing, the paper passes through a print zone 42 whereupon a scanning carriage 44 containing one or more printheads 16 is scanned across the sheet for printing a swath of ink thereon. The sheet of paper is stepped through the print zone 42 as the scanning carriage 44 prints a series of swaths of ink to form images thereon. After printing is complete, the sheet is positioned into an output tray 46. The positioning of paper supply 40 and output tray 46 can vary depending on the particular sheet feed mechanism used. Scanning carriage 44 slides through the print zone 42 on a scanning mechanism which includes a slide rod 48. A positioning means such as a coded strip (not shown) is used in conjunction with a photo detector for precisely positioning scanning carriage 44. A stepper motor (not shown), connected to scanning carriage 44 using a conventional drive belt and pulley arrangement, is used for transporting scanning carriage 44 across print zone 42. A ribbon cable (not shown) carries electrical signals to the scanning carriage 44 for selectively energizing the printheads 16 (FIGS. 1 and 2). As the printheads 16 are selectively energized, ink of a selected color is ejected onto the print media as scanning carriage 44 passes through print zone 42.

Figure 3:
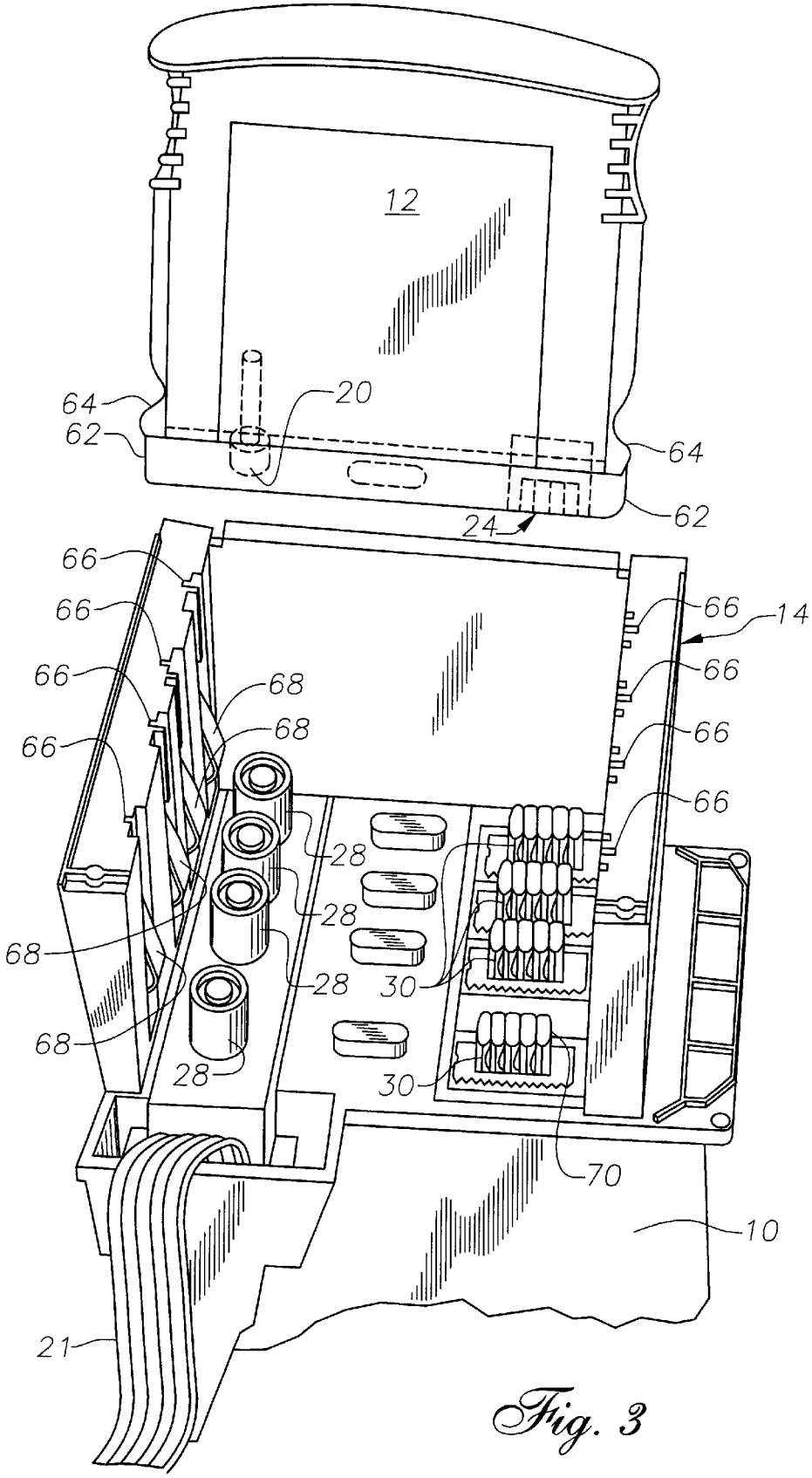
FIG. 3 is an isometric view of an ink supply station on the ink-jet printer of FIG. 2.
Figure 4:
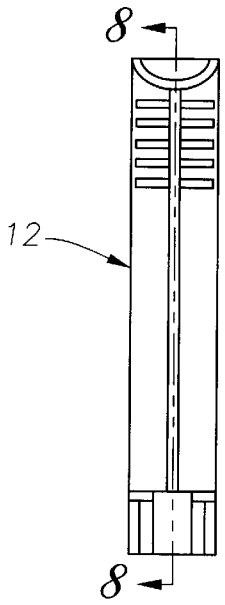
FIG. 4 is a side view of the ink container of FIG. 1.
Figure 5:
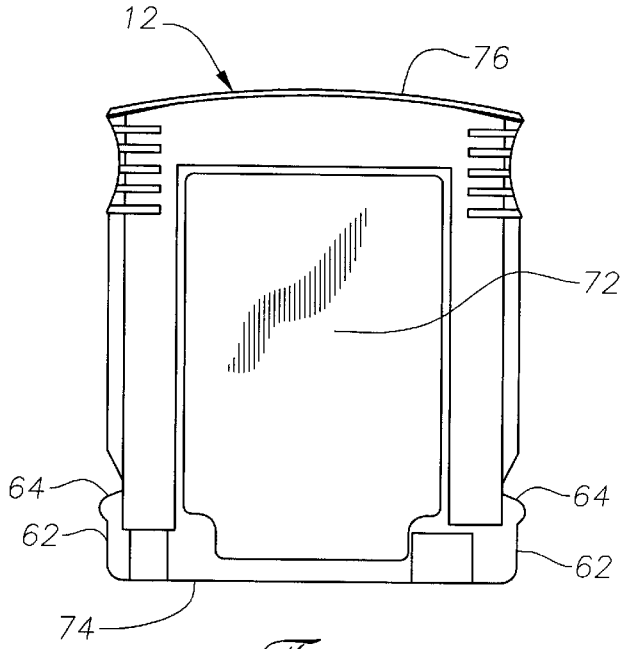
FIG. 5 is a front view of the ink container of FIG. 1.
Figure 6:
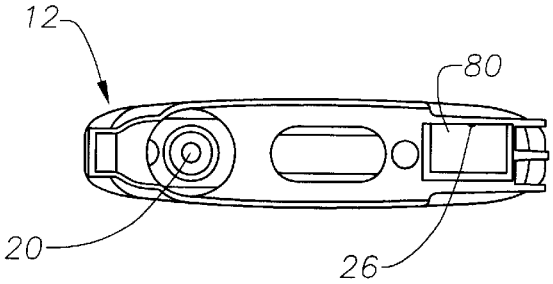
FIG. 6 is a bottom view of the ink container of FIG. 1.

Each ink container 12 has its own electrical contacts 24 and fluid outlet 20 (FIG. 3). Ink containers 12 may be referred to as an off-axis ink supply since the ink supply is spaced from a scan axis defined by scanning carriage 44. In the case of color printing, ink containers 12 are typically separate ink containers for each color with a container for black ink. For example, ink container 12 for the embodiment shown in FIG. 2 is an ink container 54 for black ink, an ink container 56 for yellow ink, an ink container 58 for magenta ink, and an ink container 60 for cyan ink. Receiving station 14 contains mechanical, fluid and electrical interfaces for each ink container 12. Ink passes through the fluid interfaces in receiving station 14, fluid conduits 21 and then to printheads 16 on print scanning carriage 44.

Figure 8:
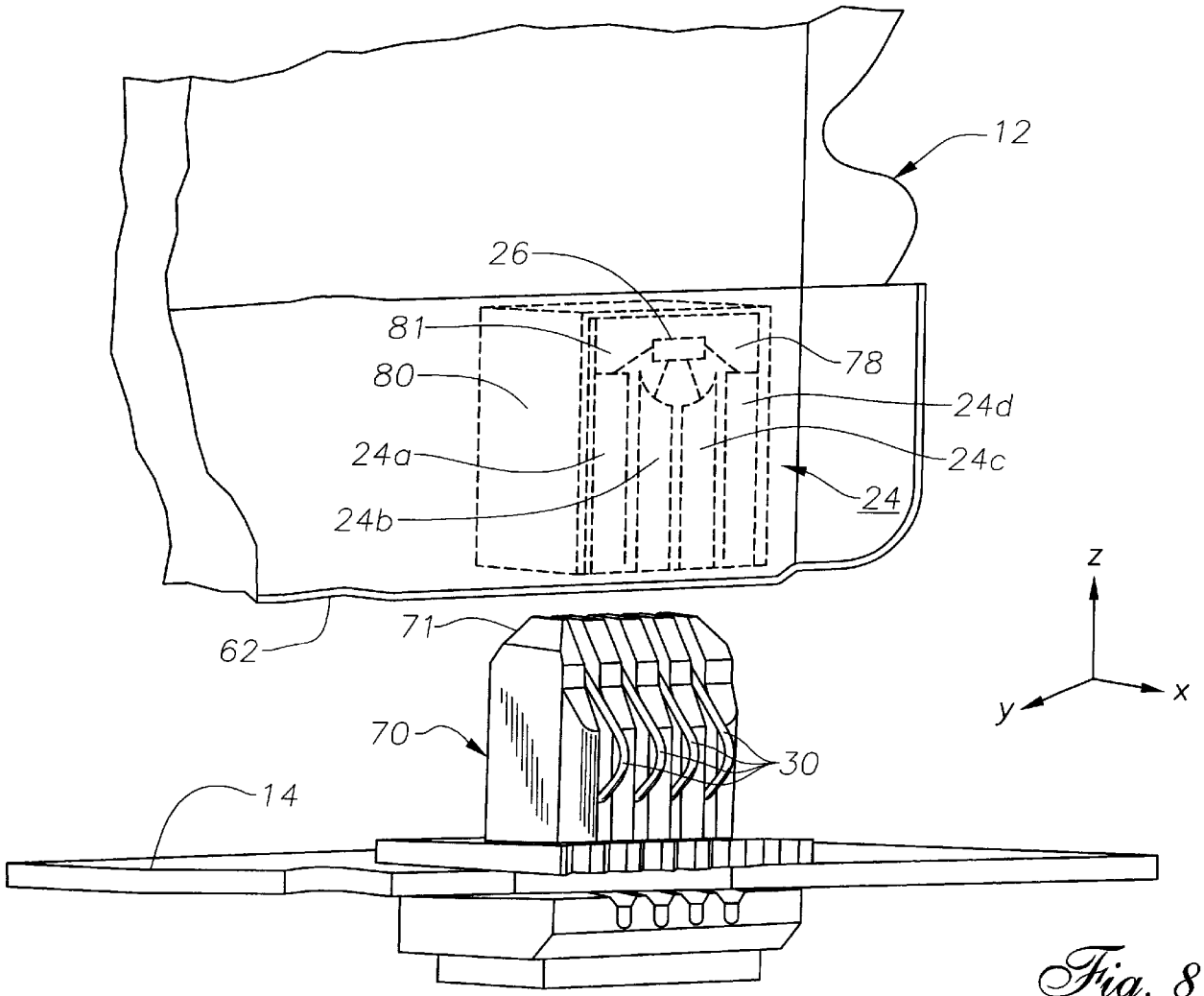
FIG. 8 is an isometric view of a lower portion of the ink container of FIG. 1, shown prior to engaging the electrical connector of the ink-jet printer of FIG. 2.

Referring to FIG. 3, receiving station 14 has four separate electrical connector posts 70, one for each of the cartridges 12. The four electrical contacts 30 are mounted to each electrical connector post 70, as shown in FIG. 8. Each connector post 70 protrudes upwardly and has a tapered leading edge portion 71. Contacts 30 are outwardly spring biased from connector post 70.

Figure 7:
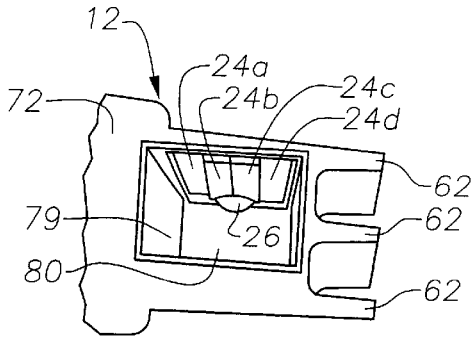
FIG. 7 is an enlarged bottom view of the ink container of FIG. 1, showing details of the electrical interconnect portion of the ink container.

Referring again to FIG. 3, one of the ink containers 12 is positioned for insertion into receiving station 14 of printer 10. Ink container 12 contains a supply of media marking fluid such as ink. As described above, ink container 12 has fluid outlet 20 and electrical contacts 24. Also, as shown in FIG. 7, ink container has aligning ribs 62 on each side edge. Aligning ribs 62 mate with slots 66 on receiving station 14 to assist in aligning ink container 12 for insertion into receiving station 14. Aligning ribs 62 and slots 66 also provide a keying function to ensure that ink container 12 contains ink having the proper parameters, such as color and ink compatibility with printer 10. Ink container also has latch shoulders 64 on each side edge, as shown in FIG. 3, which are engaged by resilient latches 68 mounted on the sidewalls of receiving station 14.

Once ink container 12 is aligned and inserted into receiving station 14, latches 68 on receiving station 14 engage corresponding latch shoulders 64 on ink container 12. Insertion of ink container 12 into receiving station 14 forms both electrical and fluid interconnects between contacts 24 and 30, and ports 20 and 28, respectively.

Ink container 12 is shown in detail in FIGS. 4–7. Ink container 12 includes an outer surface or housing 72 having a leading edge or end 74 and a trailing edge or end 76 relative to the direction of insertion of ink container 12 into receiving station 14. There are four terminals or contacts 24 on the ink container, 24*a* for ground, 24*b* for clocking signals, 24*c* for power, and 24*d* for input and output data Contacts 24 are located in a small cavity 80 on a lower side of housing 72 adjacent to leading edge 74.

Figure 9:
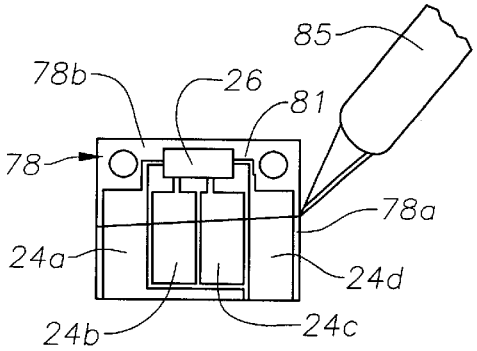
FIG. 9 is an enlarged view of the electrical contacts and memory device of the ink container of FIG. 1, showing traces between the contacts and the memory device being severed to disable the memory device.

Referring to FIG. 9, contacts 24 are metal conductive layers disposed on a non-conductive substrate 78 such as epoxy and fiberglass. Four traces or leads 81 are disposed on substrate 78, each extending from one of the contacts 24. Memory device 26 is mounted to substrate 78, and the terminals of memory device 26 are joined to the traces 81. This places terminals of the memory device 26 in electrical continuity with contacts 24. A protective coating (not shown), such as epoxy, is used to encapsulate memory device 26 after its terminals are bonded to traces 81. A backside of the substrate 78, opposite the contacts 24 and memory device 26, is bonded by adhesive or swaged to a sidewall of cavity 80 (FIG. 7). With the ink container 12 properly inserted into the receiving station 14, electrical contacts 24 associated with the ink container are positioned for engagement with electrical contacts 30 (FIG. 8) associated with the receiving station 14.

The entrance to cavity 80 is sized to be small enough to reduce the possibility of fingers from entering cavity 80. The proper sizing of the entrance is important for preventing contamination of contacts 24 during handling of ink container 12. Referring to FIG. 8, cavity 80 closely receives one of the connector posts 70. As ink container 12 is inserted into printer 10, contacts 30 are compressed against contacts 24 to form a low resistance electrical connection between printer 10 and memory device 26.

Each ink container 12 has ink related parameters which are unique to the particular ink container and the ink within the ink container. These parameters are stored in the information storage device 26 associated with the ink container 12. The parameters in the information storage device 26 are provided to the controller 18 automatically without requiring the user to configure printer 10 for the particular ink container 12 installed. Memory device 26 has a read-only section, a write-once section, and a multiple write/erase section. The read only section is write enabled during the initial installation. When the cartridge is first installed in the printer 10, the printer 10 reads ink container information such as the manufacturer identity, part identification, date code of ink supply, system coefficients, service mode and ink supply size. The printer 10 then stores the installation date in the read only section of storage device 26, then initiates a write protect feature to assure that the information in the read-only section remains the same. The initial installation date is used by the printer 10 to determine if an ink container has been installed for an extended period of time which, if long enough, can reduce print quality.

The write once section is a portion of memory which can be written to by printer 10 only one time. The multiple write/erase section can be written to and erased repeatedly. Both of these sections deal with storing information concerning current ink quantity. As will be explained below, the coarse bit information is stored in the write once section and the fine bit data is stored in the multiple write/erase section.

Upon insertion of ink container 12 into printing system 10, controller 18 reads parameter information from information storage device 26 for controlling various printing functions. For example, controller 18 uses parameter information to compute an estimate of remaining ink. If the ink remaining is less than a low ink threshold volume, a message is provided to the user indicating such. Further, when a substantial portion of the ink below the threshold volume is consumed, controller 18 can disable printing system 10 to prevent operation of the printhead 16 without a supply of ink. Printhead 16 operation without ink can result in reduction of printhead reliability or catastrophic failure of the printhead 16. Controller 18 can also provide notice to the user when the ink is beyond its shelf life so that ink container 12 can be replaced to ensure maximum print quality.

In operation, the printing system 10 reads initial volume information from the memory device 26 associated with the ink container 12. As ink is used during printing this ink is monitored by the printing system 10 and the memory device 26 is updated to contain information relating to remaining ink in the ink container 12. The printing system 10 thereafter monitors the level of deliverable ink in ink container 12 via memory device 26. In a preferred embodiment, data is transferred between the printer 10 and the memory device 26 in serial fashion using the single data line 24*d* relative to ground.

In a preferred embodiment, the volume information includes the following: (1) initial supply size data in a write protected portion of memory, (2) coarse ink level data stored in write once portion of memory, and (3) fine ink level data stored in a write/erase portion of memory. The initial supply size data is indicative of the amount of deliverable ink initially present in ink container 12.

The coarse ink level data includes a number of write once bits that each correspond to some fraction of the deliverable ink initially present in ink container 12. In a first preferred embodiment, eight coarse ink level bits each corresponding to one eighth of the deliverable ink initially in ink container 12. In a second preferred embodiment, to be used in the discussion that follows, seven coarse ink level bits each correspond to one eighth of the deliverable ink initially present in ink container 12 and one coarse ink level bit corresponds to an out of ink condition. However, more or less coarse bits can be used, depending on the accuracy desired for a coarse ink level counter.

The fine ink level data is indicative of a fine bit binary number that is proportional to a fraction of one eighth of the volume of the deliverable ink initially present in ink container 12. Thus, the entire range of the fine bit binary number is equivalent to one coarse ink level bit. This will be further explained below.

Printing system 10 reads the initial supply size data and calculates the amount or volume of deliverable ink initially present in ink container 12. The drop volume ejected by the printhead 16 is determined by printing system 10 by reading parameters and/or performing calculations. Using the initial volume of deliverable ink in ink container 12 and the drop volume of printhead 16, the printing system 10 calculates the fraction of the initial deliverable ink volume that each drop represents. This enables the printing system 10 to monitor the fraction of the initial volume of deliverable ink remaining in ink container 12.

While printing, printing system 10 maintains a drop count equal to the number of ink drops that have been ejected by printhead 16. After printing system 10 has printed a small amount, typically one page, it converts the drop count to a number of increments or decrements of the fine bit binary number. This conversion utilizes the fact that the entire range of the fine bit binary number corresponds to one eighth of the initial volume of deliverable ink in ink container 12. Each time the fine bit binary number is fully decremented or incremented, the printing system 10 writes to one of the coarse ink level bits to "latch down" the bit.

Printing system 10 periodically queries the coarse and fine ink level bits to determine the fraction of the initial deliverable ink that is remaining in ink container 12. Printing system 10 can then provide a "gas gauge" or other indication to a user of printing system 10 that is indicative of the ink level in ink container 12. In a preferred embodiment, the printing system provides a "low ink warning" when seventh (second to last) coarse ink level bit is set. Also in a preferred embodiment, the printing system sets the last coarse ink level bit when the ink container 12 is substantially depleted of ink. This last coarse ink level bit is referred to as an "ink out" bit. Upon querying the coarse ink level bits, the printing system interprets a "latched down" ink out bit as an "ink out" condition for ink container 12.

In printing system 10, the transfer of data between printer 10 and memory device 26 is in serial fashion on the single data line relative to ground. As explained above, while the ink in ink container 12 is being depleted, memory device 26 stores data which is indicative of its initial and current states. Printer 10 updates memory device 26 to indicate the volume of ink remaining. When most or substantially all of the deliverable ink has been depleted, printer 10 alters memory device 26 to allow ink container 12 to provide an "ink out" signal. Printer 10 may respond by stopping printing with ink container 12. At that point, the user will insert a new ink container 12 or one that has been refilled and electrically refurbished in accordance with this invention.

Ink container 12 is fluidically refurbished by refilling it with ink. After the ink container 12 is partially depleted of ink, the memory device 26 contains data relative to remaining ink. As explained above, the coarse bit counter reflecting remaining ink is stored in the write once section of memory 26. Consequently, refilling the ink container 12 results in the alteration of the amount of ink remaining but does not change the coarse bit counter indicating the amount of remaining ink. Therefore, the memory device 26 does not provide accurate ink Remaining information resulting in improper low ink condition signals. In addition, because the refilled ink does not have the same ink parameters as those ink parameters stored in the memory device 26 the printing system 10 can not properly compensate for this refilled ink to ensure high print quality.

The purpose of this invention is to electrically refurbish ink container 12 so that the benefits previously provided by memory device 26 still exist. In this invention, the pre-existing data in memory device 26 is prevented from further communication with printer 10 when cartridge 12 is installed again. In one technique, all of the data in memory device 26 is erased. This can be accomplished by exposing the memory device 26 to an energy source such as an x-ray or electric field. This energy source, if sufficient, resets the data in memory device 26. The reservoir of ink container 12 is then refilled. Then memory device 26 can be reprogrammed to reflect parameters of the refilled ink container 12. When installed in the printing system 10 the printing system operates with the ink container 12 in a manner similar to the initial ink container.

Figure 10:
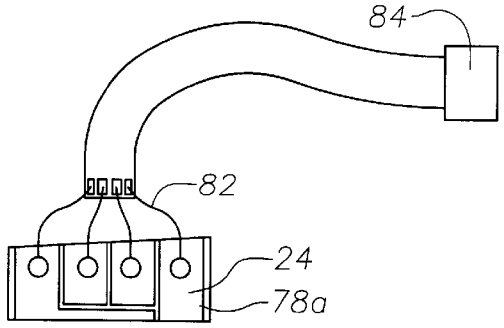
FIG. 10 is an enlarged view of the electrical contacts of FIG. 9, shown attached to a new source of signals.

In another refurbishment method, memory device 26 is disabled and replaced with an identical one or with an emulator 84 (FIG. 10). The new memory device 26 may be an emulator or a substantial replica of the original memory device 26. Emulator 84 is an electronic circuit that is functionally equivalent to memory device 26 in providing information to printer 10 (FIG. 1) although structurally this device may be very different. Emulator 84 would likely have a portion that functions as a memory and would likely provide information regarding the volume of reservoir 22, the type of ink, color, etc. Optionally, unlike original memory device 26, emulator 84 may be reset in a different manner whenever a new ink supply is provided. Further, emulator 84 may be configured to provide information to printer 10 which enables it to operate regardless of the actual condition of the ink in ink reservoir 22.

The new source of signals, such as emulator 84 or a new memory device 26, must be provided with the data required for proper operation of printer 10. The new source of signals must be able to communicate with printer 10 over a single wire input/output in serial fashion. The data provided by the memory device 26 is used by printer 10 to generate an indication of the volume of ink available.

In one technique for refurbishing ink container 12, the first memory device 26 will be removed from cavity 80 of housing 72 (FIG. 7). Substrate 78 (FIG. 9), along with memory device 26 and contacts 24, may be pried off or otherwise removed as a unit from cavity 80. A new substrate 78, having a new memory device 26 or emulator 84 and contacts 24, may be adhesively bonded to a sidewall of cavity 80 in the same place that held the original substrate 78, memory device 26 and contacts 24. Alternately, a substrate 78 containing only a new set of contacts 24 may be mounted in cavity 80. The new memory device 26 or emulator 84 may be mounted at another place on housing 72 of refurbished cartridge 12 and connected to the new set of contacts 24 by leads. As indicated in FIG. 10, emulator 84 may also be located remotely from or not immediately adjacent to printer 10 and connected by leads 82 to contacts 24 within cavity 80.

Another refurbishment method allows the original substrate 78, memory device 26 and contacts 24 to remain in place. A new substrate 78, along with a new memory device 26 and contacts 24, will be bonded on top of the original memory device 26 and contacts 24. As the material of substrate 78 is an electrical insulator, it will insulate the new contacts 24 and traces 81 (FIG. 9) from the original contacts 24 and traces 81. The original contacts 24 will not be able to electrically engage printer contacts 30 (FIG. 8) because they will be covered and insulated from engagement by the new substrate 78. This technique may be performed several times before electrical connection with printer 10 becomes difficult due to space constraints. Cavity 80 becomes effectively smaller each time a new substrate 78, along with new contacts 24 and a new memory device 26, are installed on top of an earlier set.

In another refurbishment process, a usable portion of the original contacts 24 remains in place and is electrically separated from the original memory device 26. In this method, preferably a cut is made through substrate 78 transversely across one or more contacts 24 with a sharp object such as knife 85 as shown in FIG. 9. The cut divides substrate 78 into retained and disposable portions **78*a*, 78*b*, the retained portion 78*a* of which contains a significant portion of contacts 24. Substrate disposable portion 78*b* contains memory device 26, along with traces 81 and a small adjacent part of contacts 24. This cut severs electrical continuity between the four terminals of memory device 26 with the part of contacts 24 contained on the substrate retained portion 78*a*. Although, the size of contacts 24 on substrate retained portion 78*a* would be smaller than the original contacts 24, they are of adequate size to mate with printer contacts 30 (FIG. 8**).

Normally, one would then remove from cavity 80 the disposable substrate portion **78*b*, along with the first memory device 26, traces 81, and the part of contacts 24 contained thereon. A new memory device 26 may then be mounted adjacent to or on the original contacts 24 contained on the retained substrate portion 78*a*, with its terminals connected to them. Optionally, the new memory device 26 could be mounted elsewhere on housing 72 other than cavity 80 (FIG. 7) or even remotely from printer 10 and connected to original contacts 24 by leads. If an emulator 84 is used rather than the memory device 26, it too may be mounted on housing 72 in a place other than in cavity 80, or it may be mounted in cavity 80 adjacent to or on substrate retained portion 78***a*. Alternately, as illustrated in FIG. 10, the contacts 24 on substrate retained portion 78*a* may be connected to leads 82 that are attached to a remotely located emulator 84. Contacts 24 may be connected to leads 82 or to leads or terminals of a new memory device 26 by soldering, wire bonding, TAB bonding, etc.

The above descriptions thus explain several ways to refurbish memory device 26: (1) erase and reprogram; (2) remove and replace the entire substrate 78, along with contacts 24 and memory device 26; (3) mount a new substrate 78 along with a new memory device 26 and contacts 24 on top of the original substrate 78, contacts 24, and memory device 26; (4) or sever the original substrate 78 into retained and disposable portions 78*a*, 78*b*, and connect a new memory device 26 or emulator 84 to the contacts 24 on retained portion 78*a*. The above descriptions also explain that the new source of signals could be an emulator 84 or a substitute memory device 26. The emulator 84 or new memory device 26 may be mounted to housing 72 in cavity 80 or elsewhere, or they may be located remotely.

Figure 11:
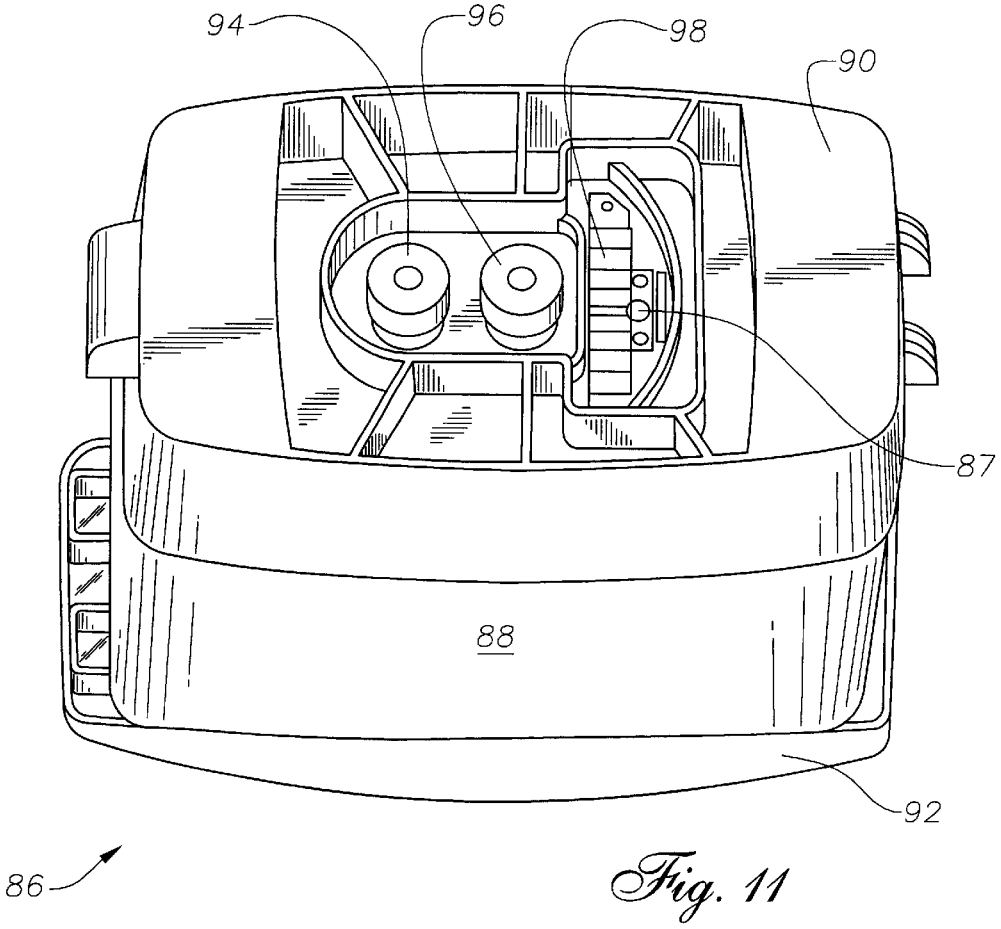
FIG. 11 is an end isometric view of a second type of ink cartridge for refurbishment in accordance with this invention, the second type having a larger volume reservoir than the ink cartridge of FIGS. 1–10.

In addition to electrically refurbishing ink container 12, it will also be refilled with ink. Various methods for refilling ink container 12 are described in a patent application Ser. No. 09/034,719 entitled "Ink Container Refurbishment Method", filed concurrently with this application. Another type of ink cartridge that may be refurbished in accordance with this invention is illustrated in FIG. 11. Cartridge 86 is used with a different printer (not shown) than printer 10 of FIGS. 1–10 and holds a larger volume of ink than cartridge 12 (FIG. 1). Unlike cartridge 12, cartridge 86 has an inductive ink level sensor (not shown) as well as a memory device 87. The printing system with which cartridge 86 is used identifies three phases of ink usage. During phase one, both fine and coarse counters are used as described above for printer 10. Ink drops are counted and recorded in the fine counter portion of memory device 86. Each time the fine counter fully increments or decrements, another coarse counter bit will be set. During phase two, only the ink level sensor is used. At the start of phase three, the fine counter is reset and used in the same manner as during the first phase. When the final coarse counter bit is set, a "ink out" warning will be indicated to the printer. The three-phase arrangement is provided because the inductive ink level sensor provided with ink container 86 is sufficiently accurate in the second phase but not in the first and third phases.

Ink container 86 has a housing 88 which contains an ink reservoir (not shown). Housing 88 has a leading end or edge 90 and trailing end or edge 92 relative to a direction of insertion into a printer (not shown). Leading edge 90 includes an air inlet 94 and a fluid outlet 96 which connect to the printer.

A plurality of electrical contacts 98 are disposed within a receptacle on leading end 90 for providing electrical connection between ink container 86 and the printer. Originally, contacts 98 are electrically interconnected to memory device 87 and to the ink volume sensor (not shown). The electrical refurbishment techniques described above for ink container 12 are equally applicable to ink container 86, information storage device 87 and contacts 98. The new source of signals to replace memory device 87 may be a near duplicate to the original one or an emulator.

The invention has several advantages. The electrical refurbishment methods described allow ink containers which are otherwise single use to be reused while maintaining the electrical interconnect between the ink container and the printer.

Although the present invention has been described with respect to the preferred embodiment where the ink container 12 is mounted off of the print carriage 44 the present invention is suited for other printer configurations as well. For example, the ink containers may each be mounted on the printing carriage 44. For this configuration each of the printhead and the ink container portion are separately replaceable. Each of the printhead and the ink container includes a storage device 26 providing information to the printer 10. Each ink container of a plurality of ink containers may be separately replaceable or replaceable as an integrated unit. For the case where the plurality of ink containers is integrated into a single replaceable printing component then only a single storage device 26 is required for this single replaceable printing component.

What is claimed is:

1. A method of re-using an ink container which is in an at least partially depleted of ink condition, the ink container including a first memory device associated with the ink container for communication with a printer when the ink container is connected to the printer, the first memory device containing first parameters relating to the ink contained in the at least partially depleted of ink condition of the ink container, the method comprising the steps of:

(a) refilling the ink container with ink to a refilled ink condition;

(b) preventing the first parameters, related to the ink contained in the at least partially depleted of ink condition of the ink container from further communication with the printer when the ink container is connected to the printer; and (c) modifying the first memory device by providing the ink container with a second memory device in place of the first memory device and storing second parameters in the second memory device such that when the ink container having the refilled condition is connected to the printer, the second parameters, related to the refilled ink condition of the ink container are electronically communicated with the printer.

2. A method of re-using an ink container which is in an at least partially depleted of ink condition, the ink container including a first memory device associated with the ink container for communication with a printer when the ink container is connected to the printer, the first memory device containing first parameters relating to the ink contained in the at least partially depleted of ink condition of the ink container, the method comprising the steps of:

(a) refilling the ink container with ink to a refilled ink condition;

(b) removing the first memory device from the ink container to prevent the first parameters, related to the ink contained in the at least partially depleted of ink condition of the ink container from further communication with the printer when the ink container is connected to the printer; and (c) modifying the first memory device by providing a second memory device in place of the first memory device and storing second parameters in the second memory device such that when the ink container having the refilled condition is connected to the printer, the second parameters, related to the refilled ink condition of the ink container are electronically communicated with the printer.

3. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having been electrically altered during usage of ink from the ink container such that the first memory device provides a remaining ink quantity signal to the printing system indicative of at least a partially depleted ink state, the method comprising the steps of:

(a) preventing the remaining ink quantity signal of the first memory device of the ink container from communicating further with the printing system when the ink container is connected to the printing system; and (b) modifying the first memory device by providing a second memory device as the source signals in place of the first memory device such that when the ink container is electrically connected to the printer contacts, a signal from a source of signals is provided to the printing system indicative of an available ink state of the ink container that is greater than the at least a partially depleted ink state of the ink container previously signaled by the remaining ink quantity signal.

4. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having write-once sectors of memory that have been electrically altered by the printing system during usage of ink from the ink container such that the first memory device provides a remaining ink quantity signal to the printing system indicative of at least a partially depleted ink state, the method comprising the steps of:

(a) preventing the remaining ink quantity signal of the first memory device of the ink container from communicating further with the printing system when the ink container is connected to the printing system; and (b) modifying the first memory device by providing a second memory device as a source of signals in place of the first memory device, the second memory device having corresponding write-once sectors of memory that have not been altered by the printing system, such that when the ink container is electrically connected to the printer contacts, a signal from the source of signals is provided to the printing system indicative of an available ink state of the ink container that is greater than the at least a partially depleted ink state of the ink container previously signaled by the remaining ink quantity signal.

5. A method of re-using an ink container having a reservoir that has been at least partially depleted of ink, the ink container having a first memory device that is coupled to a plurality of ink container contacts disposed on an end of the ink container which engage mating printer contacts of a printing system upon installation of the ink container into the printing system for communicating between the first memory device and the printing system, the first memory device having been electrically altered during usage of ink from the ink container such that the first memory device provides a remaining ink quantity signal to the printing system indicative of at least a partially depleted ink state, the method comprising the steps of:

(a) preventing the remaining ink quantity signal of the first memory device of the ink container from communicating further with the printing system when the ink container is connected to the printing system; and (b) modifying the first memory device by mounting a second plurality of ink container contacts on the end of the ink container proximate to a location of said first mentioned plurality of ink container contacts, such that upon installation of the ink container into the printing system, the second plurality of ink container contacts connect to the printer contacts such that with the ink container electrically connected to the printer contacts, a signal from a source of signals is provided to the printing system indicative of an available ink state of the ink container that is greater than the at least a partially depleted ink state of the ink container previously signaled by the remaining ink quantity signal.

6. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having been electrically altered during usage of ink from the ink container such that the first memory device provides a remaining ink quantity signal to the printing system indicative of at least a partially depleted ink state, wherein the first memory device and the plurality of ink container contacts are mounted to a first substrate that is secured to the ink container, the method comprising the steps of:

(a) removing the first substrate from the ink container, along with the first memory device and the plurality of ink container contacts, by prying the first substrate from the ink container to prevent the remaining ink quantity signal of the first memory device of the ink container from communicating further with the printing system when the ink container is connected to the printing system; and (b) modifying the first memory device such that when the ink container is electrically connected to the printer contacts, a signal from a source of signals is provided to the printing system indicative of an available ink state of the ink container that is greater than the at least a partially depleted ink state of the ink container previously signaled by the remaining ink quantity signal.

7. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having been electrically altered during usage of ink from the ink container such that the first memory device provides a remaining ink quantity signal to the printing system indicative of at least a partially depleted ink state, the method comprising the steps of:

(a) severing electrical continuity between the first memory device and at least a portion of the plurality of ink container contacts to prevent the remaining ink quantity signal of the first memory device of the ink container from communicating further with the printing system when the ink container is connected to the printing system; and (b) connecting the source of signals to said at least a portion of the plurality of ink container contacts to modify the first memory device such that when the ink container is electrically connected to the printer contacts, a signal from a source of signals is provided to the printing system indicative of an available ink state of the ink container that is greater than the at least a partially depleted ink state of the ink container previously signaled by the remaining ink quantity signal.

8. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having been electrically altered during usage of ink from the ink container such that the first memory device provides a remaining ink quantity signal to the printing system indicative of at least a partially depleted ink state, wherein the first memory device and the plurality of ink container contacts are mounted to a first substrate that is secured to the ink container, the method comprising the steps of:

(a) preventing the remaining ink quantity signal of the first memory device of the ink container from communicating further with the printing system when the ink container is connected to the printing system; and (b) modifying the first memory device by placing a second substrate having a second set of ink container contacts and a second memory device on top of the first memory device and said first mentioned plurality of ink container contacts such that when the ink container is electrically connected to the printer contacts, a signal from a source of signals is provided to the printing system indicative of an available ink state of the ink container that is greater than the at least a partially depleted ink state of the ink container previously signaled by the remaining ink quantity signal.

9. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having been electrically altered during usage of ink from the ink container such that the first memory device provides a remaining ink quantity signal to the printing system indicative of at least a partially depleted ink state, the method comprising the steps of:

(a) preventing the remaining ink quantity signal of the first memory device of the ink container from communicating further with the printing system when the ink container is connected to the printing system; and (b) modifying the first memory device by providing an emulator as a source of signals in place of the first memory device such that when the ink container is electrically connected to the printer contacts, a signal from the source of signals is provided to the printing system indicative of an available ink state of the ink container that is greater than the at least a partially depleted ink state of the ink container previously signaled by the remaining ink quantity signal.

10. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system the first memory device having a first plurality of write-once usage bits of memory that have been electrically altered during usage of ink from the ink container by being latched down by the printing system such that the first memory device provides a remaining ink quantity signal to the printing system indicative of at least a partially depleted ink state, the method comprising the steps of:

(a) preventing the remaining ink quantity signal of the first memory device of the ink container from communicating further with the printing system when the ink container is connected to the printing system; and (b) modifying the first memory device by providing a second memory device in place of the first memory device with a corresponding second plurality of write-once usage bits that have not been latched down by the printing system such that when the ink container is electrically connected to the printer contacts, a signal from a source of signals is provided to the printing system indicative of an available ink state of the ink container that is greater than the at least a partially depleted ink state of the ink container previously signaled by the remaining ink quantity signal.

11. A method of re-using an ink container having a reservoir that has been at least partially depleted of ink, the ink container having a first memory device that is coupled to a plurality of ink container contacts which engage mating printer contacts of a printing system upon installation of the ink container into the printing system for communicating between the first memory device and the printing system, the first memory device having a first plurality of write-once bits which includes an out of ink bit that has been electrically altered during usage of ink from the ink container by being latched down by the printing system such that the first memory device provides a remaining ink quantity signal to the printing system indicative of an "ink out" condition, the method comprising the steps of:

(a) preventing the remaining ink quantity signal of the first memory device of the ink container from communicating further with the printing system when the ink container is connected to the printing system; and (b) modifying the first memory device by providing a second memory device in place of the first memory device, the second memory device having a second plurality of bits including a bit that has not been latched down such that when the ink container is electrically connected to the printer contacts, a signal from a source of signals is provided to the printing system indicative of an available ink state of the ink container that is greater than the at least a partially depleted ink state of the ink container previously signaled by the remaining ink quantity signal.

12. A method for re-using a printer ink container having an ink reservoir having a substantially depleted of ink condition, the ink container having a first memory device and a set of first contacts for exchanging information with a printer via an electrical connector on the printer, the first memory device having stored therein characteristics of the ink in the ink container including the quantity of ink left in the substantially depleted of ink condition of the ink reservoir, the printer having a circuit which reads information from the first memory device to enable the printer to operate and which provides ink usage information to the first memory device, the method comprising the steps of:

(a) disabling the first memory device on the ink container such that the first memory device may no longer provide information to the printer when the ink container is connected to the printer; and (b) electrically connecting to the ink container an electrical device in place of the first memory device, the electrical device having a source of signals for providing enabling information to the printer to enable the printer to operate.

13. The method of claim 12 wherein the first memory device and the set of first contacts are mounted to a first substrate that is secured to the ink container, and wherein step (a) comprises:

removing the first substrate along with the first memory device and the set of first contacts from the ink container by prying the first substrate from the ink container.

14. The method of claim 12 wherein:

the first memory device and the set of first contacts are mounted to a first substrate that is secured to the ink container;

step (a) comprises severing the first substrate into a retained portion and a disposable portion, with at least a portion of the set of first contacts being located on the retained portion and the first memory device being located on the disposable portion; and step (b) comprises connecting the source of signals to said at least a portion of the set of first contacts on the retained portion of the first substrate.

15. The method of claim 12 wherein step (b) comprises securing the electrical device and a set of second contacts on top of the first memory device and the set of first contacts.

16. The method of claim 12 wherein step (b) comprises affixing the electrical device directly to an exterior surface of the ink container.

17. The method of claim 12 wherein step (b) comprises remotely locating the electrical device from the ink container.

18. The method of claim 12 wherein step (b) comprises providing the electrical device with serial input/output circuitry so that input/output data, clocking requirements, electrical power and an electrical ground may be established between the electrical device and the printer when the ink container is connected to the printer.

19. The method of claim 12 wherein step (b) comprises providing the electrical device with a memory portion to enable the circuit of the printer to write ink usage information to the memory portion.

20. A method for re-using a printer ink container having an ink reservoir for holding and dispensing ink, the ink container having a first memory device which is connected to a single data contact and a reference contact on the ink container which is electrically coupled to a single data contact and a reference contact on the printer for providing data signals in a serial fashion on the single data contact of the ink container, relative to the reference contact of the ink container, which are indicative of information stored in the first memory device, the first memory device having been electrically altered during usage of the ink from the ink reservoir such that the first memory device provides a data signal to the printer indicative of at least a partially depleted ink state of the ink reservoir, the method comprising the steps of:

(a) disabling the first memory device on the ink container such that the first memory device no longer provides the data signal to the printer indicative of at least a partially depleted ink state of the ink reservoir when the ink container is connected to the printer; and (b) electrically connecting an electrical device to the ink container in place of the first memory device, the electrical device, when connected to the printer, providing data in a serial fashion on the single data contact of the printer relative to reference contact on the printer, the electrical device providing data which is indicative of ink being available in the ink reservoir of the ink container.

21. The method of claim 20, wherein when the ink container is connected to the printer after step (a), and wherein step (b) further comprises:

receiving from the printer an address data signal in the electrical device on the single data contact of the ink container which is representative of address information;

accessing information in the electrical device corresponding to the received address information; and providing a signal to the signal data contact of the printer from the electrical device which is representative of the accessed information.

22. The method according to claim 20, wherein the first memory device is further connected to a clock contact on the ink container for controlling information transfer between the printer and the first memory device and to a supply voltage contact on the ink container which, when connected to the printer, receives a supply voltage across the supply contact and the reference contact from the printer, and wherein step (b) further comprises:

when connecting the ink container to the printer after step (a), electrically connecting the electrical device to the clock contact and the supply contact of the printer.

23. The method of claim 20 wherein the first memory device and the single data contact and reference contact of the ink container are mounted to a first substrate which is secured to the ink container, and wherein step (a) comprises removing first substrate, along with the first memory device, the single data contact and the reference contact, from the ink container.

24. The method of claim 20 wherein:

the first memory device and the single data contact and reference contact are mounted to a first substrate that is secured to the ink container;

step (a) comprises severing the first substrate into a retained portion and a disposable portion, with at least a portion of the data and reference contacts being located on the retained portion and the first memory device being located on the disposable portion; and step (b) comprises connecting the electrical device to said at least a portion of the ink container contacts on the retained portion of the first substrate.

25. The method of claim 20 wherein the first memory device and the single data contact and reference contact of the ink container are secured to the ink container, and wherein step (b) comprises:

securing the electrical device on top of the first memory device, securing a second single data contact on top of said first mentioned single data contact of the ink container, and placing a second reference contact on top of said first mentioned reference contact of the ink container.

26. The method of claim 20 wherein step (b) comprises locating the electrical device remotely from the ink container.

27. A refurbished ink container for a printer, comprising:

a reservoir which is refilled with a replacement ink which has replaced original ink stored therein such that the reservoir exhibits a refilled ink condition; and a source of signals associated with the ink container which is adapted to provide parameters relating to the refilled ink condition of the reservoir when electrically connected to the printer, the source signals having a memory portion which is capable of being written to by the printer for storing information relating to usage of the replacement ink stored in the reservoir, wherein the source of signals has a single data terminal and a reference terminal, the source of signals adapted to be responsive to control signals received from the printer on the single data terminal relative to the reference terminal for providing to the single data terminal relative to the reference terminal a data signal representative of stored information in the memory portion, the data signal adapted to be sensed by the printer.

* * * * *